US005518132A

United States Patent [19]

Chen

[11] Patent Number: 5,518,132

[45] Date of Patent: May 21, 1996

[54] RECEPTACLE HAVING PROTECTIVE FLAPS

[75] Inventor: David C. H. Chen, Taipei, Taiwan

[73] Assignee: Board Tech Electronic Co., Ltd., China

[21] Appl. No.: 511,413

[22] Filed: Aug. 4, 1995

[51] Int. Cl.[6] ..... B65D 41/16

[52] U.S. Cl. ..... 220/3.8; 220/4.02; 220/241; 220/324

[58] Field of Search ..... 220/3.2, 3.8, 3.94, 220/4.02, 241, 324

[56] References Cited

U.S. PATENT DOCUMENTS

| | | | |
|---|---|---|---|
| 3,734,335 | 5/1973 | Lincoln | 220/3.8 |
| 3,749,873 | 7/1973 | Harper et al. | 220/3.6 |
| 3,891,113 | 6/1975 | Sala | 220/3.6 |
| 4,445,622 | 5/1984 | Sideri | 220/3.6 |
| 5,183,967 | 2/1993 | Lin | 220/3.2 |
| 5,221,814 | 6/1993 | Colbaugh et al. | 220/3.6 |

*Primary Examiner*—Joseph M. Moy
*Attorney, Agent, or Firm*—Hawes & Fischer

[57] ABSTRACT

Disclosed is a receptacle having protective flaps that can prevent inadvertent insertion of alien objects into the slots of the receptacle. The receptacle having protective flaps can be made without the use of a separating plate as in the prior art so that it is cost-effective in manufacture and easy in assembly. The receptacle having protective flaps comprises a top cover having slots and a base for mounting the top cover thereon. The base has an integrally formed rib provided with paired notches to form a supporting piece therebetween. The protective flap is composed of a female frame and a male frame in which the female frame is provided with a sliding rail on lengthwise sides and the sliding rail is inset in the paired notches on the base and supported by the supporting piece so as to support the protective flap securely on the rib. An elastic piece is coupled to the protective flap for restoring the female frame and the male frame back to a closed condition when a plug is removed. The elastic piece is U-shaped and coupled to the outside of the protective flap.

5 Claims, 3 Drawing Sheets

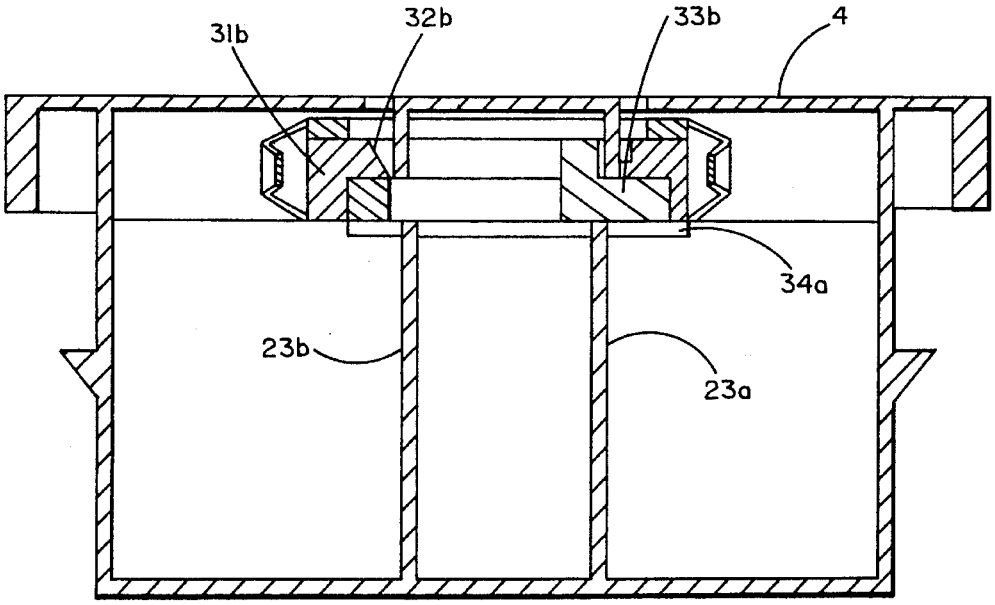
FIG. 3
FIG. 4
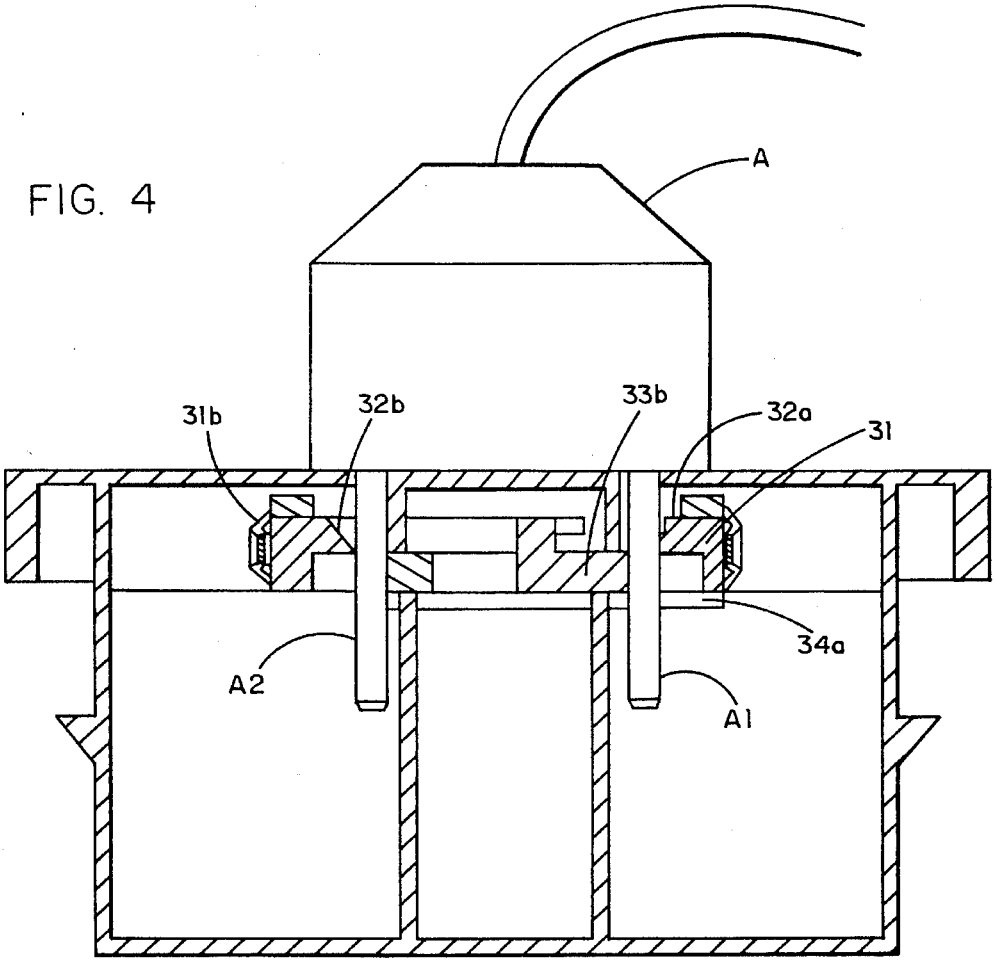

RECEPTACLE HAVING PROTECTIVE FLAPS

BACKGROUND OF THE INVENTION

1. Field of the Invention

The present invention relates to receptacles for electrical outlets, and more particularly, to a receptacle having protective flaps that can prevent inadvertent insertion of alien objects into the slots of the receptacle. For example, with the protective flap a child could not inadvertently insert an alien object into the receptacle and receive an electrical shock.

2. Description of Prior Art

FIG. 1 shows a prior art receptacle having protective flaps which is composed of a top cover 1', a base 2' for mounting the top cover 1' thereon, a separating plate 3' provided on the base 2', a protective flap 4' provided on the separating plate 3', and a U-shaped elastic piece 5' sleeved on the protective flap 4'. The protective flap 4' is composed of a pair of flames 4*a*', 4*b*' engaged by the use of an engaging piece 40'. Without a plug being inserted, the protective flap 4' is in closed condition, and when the blades a plug urge against the frames 4*a*', 4*b*', the two frames 4*a*', 4*b*' can be moved away from each other to make way for the blades of the plug to enter through the openings 30' to come into contact with the electrical outlet. When the plug is being pulled out, the frames 4*a*', 4*b*' can be urged by means of the elasticity of the U-shaped elastic piece 5' to move toward each other and close the slots of the receptacle.

It is a drawback of the prior an receptacle having protective flaps that the provision of the separating plate for supporting the protective flap makes the structure of the receptacle complex and thus the assembly is not easy and labor and time consuming that causes the manufacture cost to be high. Therefore, there exists a need for a receptacle having protective flaps that can be made with less complex components such that the assembly can be made easier.

SUMMARY OF THE INVENTION

It is therefore a primary objective of the present invention to provide a receptacle having protective flaps that eliminate the use of a separating plate as in the prior art.

It is another objective of the present invention to provide a receptacle having protective flaps that allows low cost in manufacture and easy assembly.

In accordance with the foregoing and other objectives of the present invention, there is provided a novel receptacle having protective flaps. The receptacle having protective flaps comprises a top cover having slots; a base for mounting the top cover thereon, the base having a rib provided with paired notches to form a supporting piece therebetween; a protective flap composed of a female frame and a male frame, the female frame being provided with a sliding rail on lengthwise sides, the sliding rail being inset in the paired notches on the base and supported by the supporting piece so as to support the protective flap securely on the rib; and an elastic piece coupled to the protective flap for restoring the female frame and the male frame back to a closed condition when a plug is removed. The elastic piece is U-shaped and coupled to the outside of the protective flap.

BRIEF DESCRIPTION OF DRAWINGS

The present invention can be more fully understood by reading the subsequent detailed description of the preferred embodiments thereof with references made to the accompanying drawings, wherein:

FIG. 3 shows a lengthwise cross-sectional view of the receptacle having protective flaps of FIG. 2 with its protective flaps in closed condition; and FIG. 4 shows a lengthwise cross-sectional view of the receptacle having protective flaps of FIG. 2 with its protective flaps in open condition allowing a plug to be inserted into the slot.

DETAILED DESCRIPTION OF PREFERRED EMBODIMENT

Figure 1:
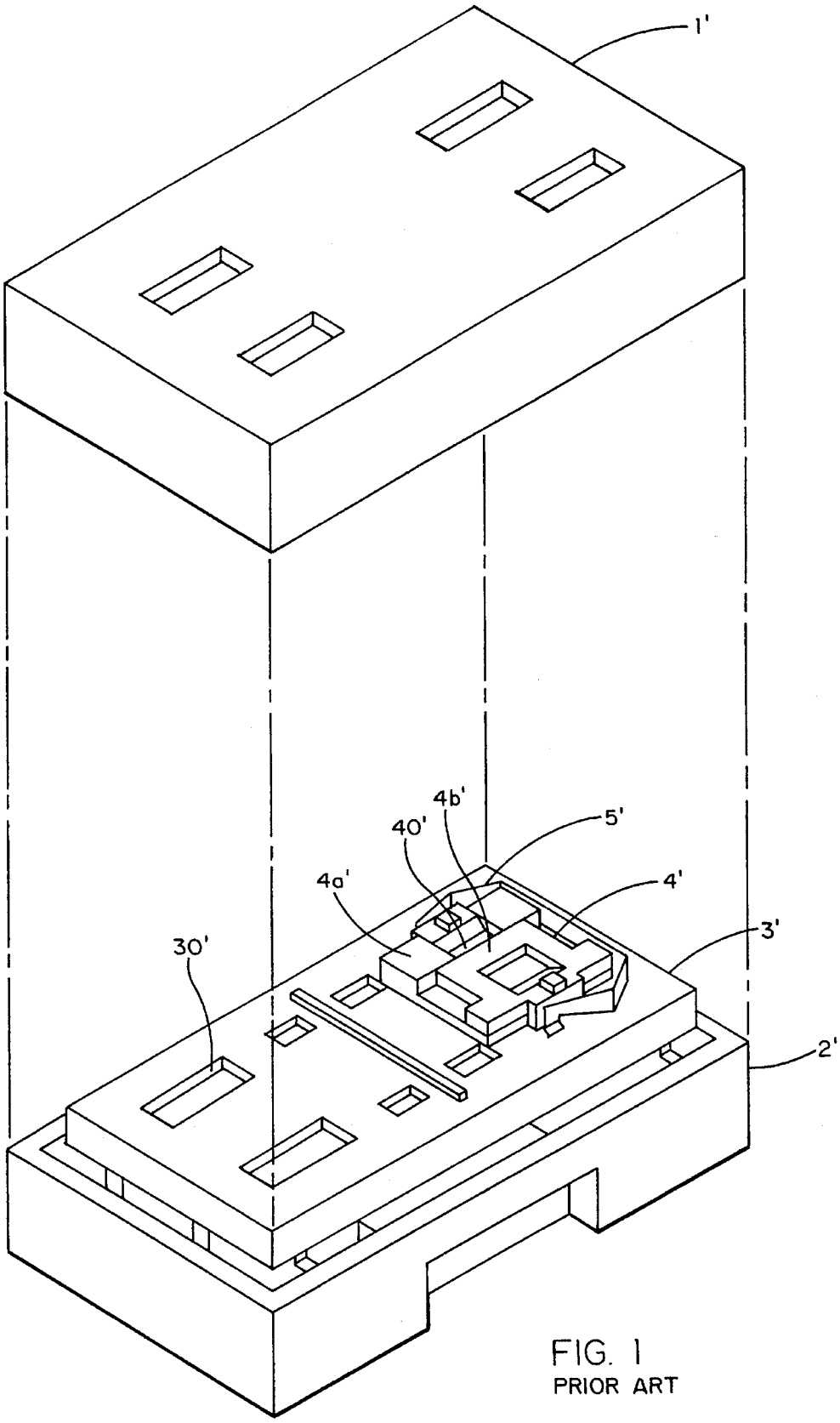
FIG. 1 PRIOR ART
FIG. 1 shows a prior art receptacle having protective flaps.
Figure 2:
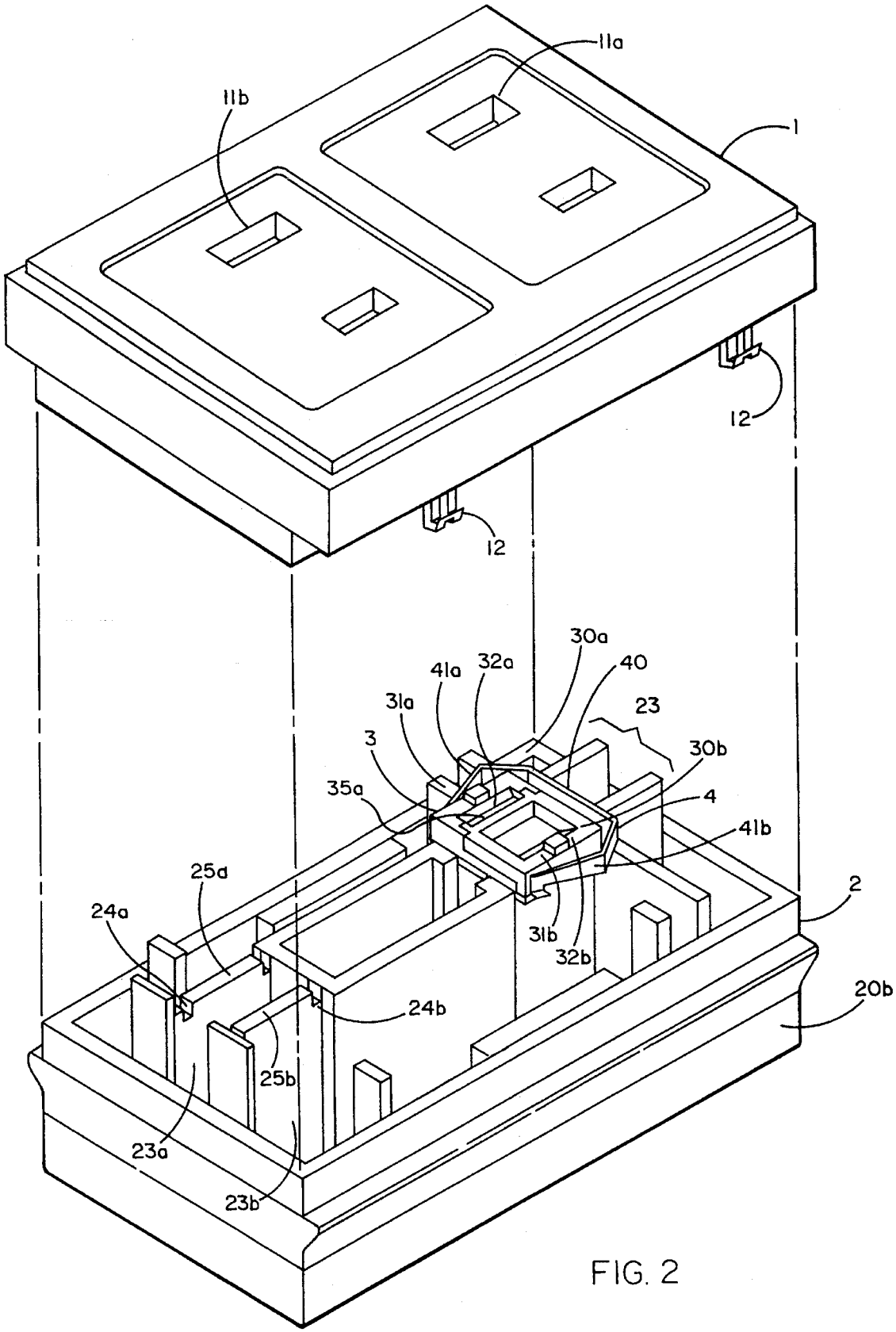
FIG. 2 shows an exploded perspective view of a receptacle having protective flaps according to the present invention.

Referring to FIG. 2, the receptacle having protective flaps according to the present invention is composed of a top cover 1, a base 2 to which the top cover 1 is mounted, protective flap 3, and a U-shaped elastic piece 4 coupled to the protective flap 3. Two pairs of slots 11*a*, 11*b* are provided on the top cover 1 for plugs (not shown) to be coupled to the electrical outlet by insertion therethrough. Hook-like engaging members 12 are provided on the bottom side of the top cover 1, which can be hook-engaged to a groove (not shown) formed on side walls 20*a*, 20*b* of the base 2 so as to combine the top cover 1 with the base 2.

A rib 23 is provided lengthwise on the bottom surface of the base 2, which includes two side pieces 23*a*, 23*b*. Paired notches 24*a*, 24*b* are provided on the side pieces 23*a*, 23*b* so as to form supporting pieces 25*a*, 25*b* used to support the protective flap 3.

The protective flap 3 is composed of a female frame 30*a* and a male frame 30*b*. The female frame 30*a* has one side 31*a* formed with a sloped surface 32*a* and a sliding rail 34*a* (best shown in FIGS. 3 and 4) is provided along the lengthwise the two dies 33*a* of the female frame 30*a*. The sliding rail 34*a* is inset onto the notches 24*a*, 24*b* on the base 2, allowing the female frame 30*a* to be slidable on the notches 24*a*, 24*b* along a specified direction. Besides, the side pieces 23*a*, 23*b* of the rib 23 allow one side 31*a* of the female frame 30*a* to be mounted thereon, such that the protective flap 3 can be supported in position. The male frame 30*b* has one side 31*b* formed with a sloped surface 32*b*. Opposite to the sloped surface 32*b* on the side 31*b* an outwardly extended horizontal tongue 33*b* is formed (best shown in FIG. 4). The tongue 33*b* is insertion-secured in a hollowed portion 35*a* of the female frame 30*a* so as to engage the female frame 30*a* with the male frame 30*b*.

The U-shaped elastic piece 4 is secured by two clamping arms 41*a*, 41*b* via an engaging portion 40. The two clamping arms 41*a*, 41*b* are urged against the side 31*a* (which is provided with the sloped surface 32*a*) on the female frame 30*a* and against the side 31*b* (which is provided with the sloped surface 32*b*) on the male frame 30*b* in such a way to separate the female frame 30*a* and the male frame 30*b*. The clamping arms 41*a*, 41*b* of the elastic piece 4, by means of their elastic property, urge the female frame 30*a* and the male frame 30*b* toward each other so as to restore them to closed condition, as illustrated in FIG. 3.

In assembly, the protective flap 3 is inserted into the rib 23 on the base 2 and the sliding rail 34*a* on the female frame 30*a* is inset in the grooves 24*a* (24*b*) on the rib 23. Then the U-shaped elastic piece 4 is connected to the outside of the protective flap 3 in such a way that its clamping arms 41*a*, 41*b* are abutted to the side 31*a* of the female frame 30*a* and the side 31*b* of the male frame 30*b*. Finally, the top cover 1 is mounted onto the base 2 by engaging the hook-like member 12 on the top cover 1 with the corresponding groove (not shown) on the base 2 and the assembly is completed.

Referring to FIG. 4, when a plug A is inserted through the slot 11*a*, 11*b* on the top cover 1, its two blades A1, A2 move downwards along the sloped surface 32*a* on the female frame 30*a* and along the sloped surface 32*b* on the male frame 30*b*, thereby forcing the female frame 30*a* and the male frame 30*b* to move away from each other, allowing the blades A1, A2 to come into contact with the electrical outlet. When pulling the plug A apart from the receptacle, the female frame 30*a* and the male frame 30*b* can be urged to move toward each other by means of the elasticity of the U-shaped elastic piece 4, thereby restoring the protective flap 3 back to the closed condition.

The present invention has been described hitherto with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. An electrical receptacle, comprising:

(a) a top cover having slots;

(b) a base for mounting said top cover thereon, said base having a rib provided with paired notches to form a supporting piece therebetween;

(c) a protective flap composed of a female frame and a male frame, said female frame and said male frame being arranged in a closed condition adjacent one another, said female frame being provided with a sliding rail on lengthwise sides, said sliding rail being inset in said paired notches on said base and supported by said supporting piece so as to support said protective flap securely on said rib, said female frame being separated from said male frame when the blades of an electrical plug are inserted through said slots of said top cover; and (d) an elastic piece coupled to said protective flap for restoring said female frame and said male frame to the closed condition when the blades of the electrical plug are removed from said slots in said top cover.

2. The electrical receptacle as claimed in claim 1, wherein said elastic piece is U-shaped and coupled to the outside of said protective flap.

3. The electrical receptacle as claimed in claim 1, wherein said U-shaped piece has a pair of clamping arms that are separated from one another by an engaging portion extending therebetween, each of said pair of clamping arms having an elastic characteristic so as to urge said female frame towards said male frame for restoring said female frame and said male frame to said closed condition when the blades of the electrical plug are removed from said slots in said top cover.

4. The electrical receptacle as claimed in claim 3, wherein said U-shaped piece is connected to the outside of said protective flap so that one of said pair of clamping arms thereof abuts said female frame and the other one of said pair of clamping arms abuts said male frame.

5. The electrical receptacle as claimed in claim 1, wherein each of said female frame and said male frame has a sloped surface to be engaged by respective ones of the blades of the electrical plug to cause said female frame to be separated from said male frame when the blades are moved through said slots in said top cover.

* * * * *